US009690241B2

(12) United States Patent
Ishida

(10) Patent No.: US 9,690,241 B2
(45) Date of Patent: Jun. 27, 2017

(54) BELT GUIDE FOR FUSER UNIT

(71) Applicant: Brother Kogyo Kabushiki Kaisha, Nagoya-shi, Aichi-ken (JP)

(72) Inventor: Kei Ishida, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/015,685

(22) Filed: Feb. 4, 2016

(65) Prior Publication Data

US 2016/0231674 A1 Aug. 11, 2016

(30) Foreign Application Priority Data

Feb. 6, 2015 (JP) ..... 2015-022604

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 15/2032; G03G 2215/2035; G03G 2215/2009
USPC ..... 399/122, 328–331
See application file for complete search history.

(56) References Cited

U.S. PATENT DOCUMENTS 7,480,481 B2 * 1/2009 Su ..... G03G 15/2039 219/216
7,627,279 B2 12/2009 Ardery et al.
2013/0136512 A1 * 5/2013 Suzuki ..... G03G 15/2053 399/329

FOREIGN PATENT DOCUMENTS

JP 2005-010201 A 1/2005

* cited by examiner

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

A fuser unit includes: an endless belt, which has an end portion having an end surface in a first direction; a nip member, which extends in the first direction and is arranged inside the endless belt; a belt guide, which is arranged to be in contact with the end surface of the endless belt and includes: a restraining part, which is configured to restrain the endless belt from moving in the first direction; and an inner surface guide, which extends from the restraining part into an inside of the endless belt and guides the inner circumferential surface of the endless belt; and an urging member, which is configured to urge the belt guide in a urging direction so that the inner surface guide is urged toward the inner circumferential surface of the endless belt.

16 Claims, 7 Drawing Sheets

BELT GUIDE FOR FUSER UNIT

CROSS-REFERENCE TO RELATED APPLICATION

This application claims priority from Japanese Patent Application No. 2015-022604 filed on Feb. 6, 2015, the entire subject matter of which is incorporated herein by reference.

TECHNICAL FIELD

The disclosure relates to a fuser unit that is used for an electrophotographic image forming apparatus.

BACKGROUND

In a background fuser unit that is used for an image forming apparatus, a fuser unit configured to heat a member to be heated by heat from a heating member via a film has been known.

As the fuser unit, a fuser unit having a film guide, which includes a restraining part configured to receive an end portion of the film and to restrain a position of the film, an inner surface guide positioned at an inner side of the end portion of the film and configured to guide rotational movement of the film and a moveable wall configured to be moveable from the inner surface guide in a direction of stretching the film, and configured to press the moveable wall by an elastic member has been known.

SUMMARY

A fuser unit according to one aspect of this disclosure includes: an endless belt, which has an end portion having an end surface in a first direction; a nip member, which is elongated in the first direction and is arranged inside the endless belt; a belt guide, which is arranged to be in contact with the end surface of the endless belt and includes: a restraining part, which is configured to restrain the endless belt from moving in the first direction; and an inner surface guide, which extends from the restraining part into an inside of the endless belt and guides the inner circumferential surface of the endless belt; and an urging member, which is configured to urge the belt guide in an urging direction so that the inner surface guide is urged toward the inner circumferential surface of the endless belt.

A fuser unit according to another aspect of this disclosure includes: a nip member, which extends in the first direction; an endless belt, which has an end portion having an end surface in a first direction and extends around the nip member; a roller, wherein the roller and the nip member are configured to pinch the endless belt therebetween to form a nip portion in which the a sheet is to be conveyed in a conveyance direction; a belt guide including: a restraining part, which is arranged to be in contact with the end surface of the endless belt to restrain the endless belt from moving in the first direction; and an inner surface guide, which extends from the restraining part into an inside of the endless belt and guides the inner circumferential surface of the endless belt; and a spring, which is arranged inside the endless belt and is configured to press the belt guide towards the inner circumferential surface of the endless belt.

A fuser unit according to another aspect of this disclosure includes: a nip member, which extends in the first direction; an endless belt, which has an end portion having an end surface in a first direction and extends around the nip member; a roller, wherein the roller and the nip member are configured to pinch the endless belt therebetween to form a nip portion, wherein a sheet is to be conveyed in a conveyance direction; a belt guide including: a restraining part, which is arranged to be in contact with the end surface of the endless belt to restrain the endless belt from moving in the first direction; and an inner surface guide, which is fixed on the restraining part, extends into an inside of the endless belt and guides the inner circumferential surface of the endless belt; and a spring, which is arranged inside the endless belt and is configured to press the belt guide towards the inner circumferential surface of the endless belt.

According to the fuser unit of the disclosure, it is possible to suppress the fuser unit from being enlarged.

BRIEF DESCRIPTION OF THE DRAWINGS

The foregoing and additional features and characteristics of this disclosure will become more apparent from the following detailed descriptions considered with the reference to the accompanying drawings, wherein:

In FIGS. 3A and 3B, a halogen heater and a wiring are omitted for convenience sake;

In FIGS. 5A and 5B, the halogen heater and the wiring are omitted for convenience sake;

DETAILED DESCRIPTION

1. Overall Configuration of Image Forming Apparatus

A printer 1 is an electrophotographic monochrome printer.

Figure 1:
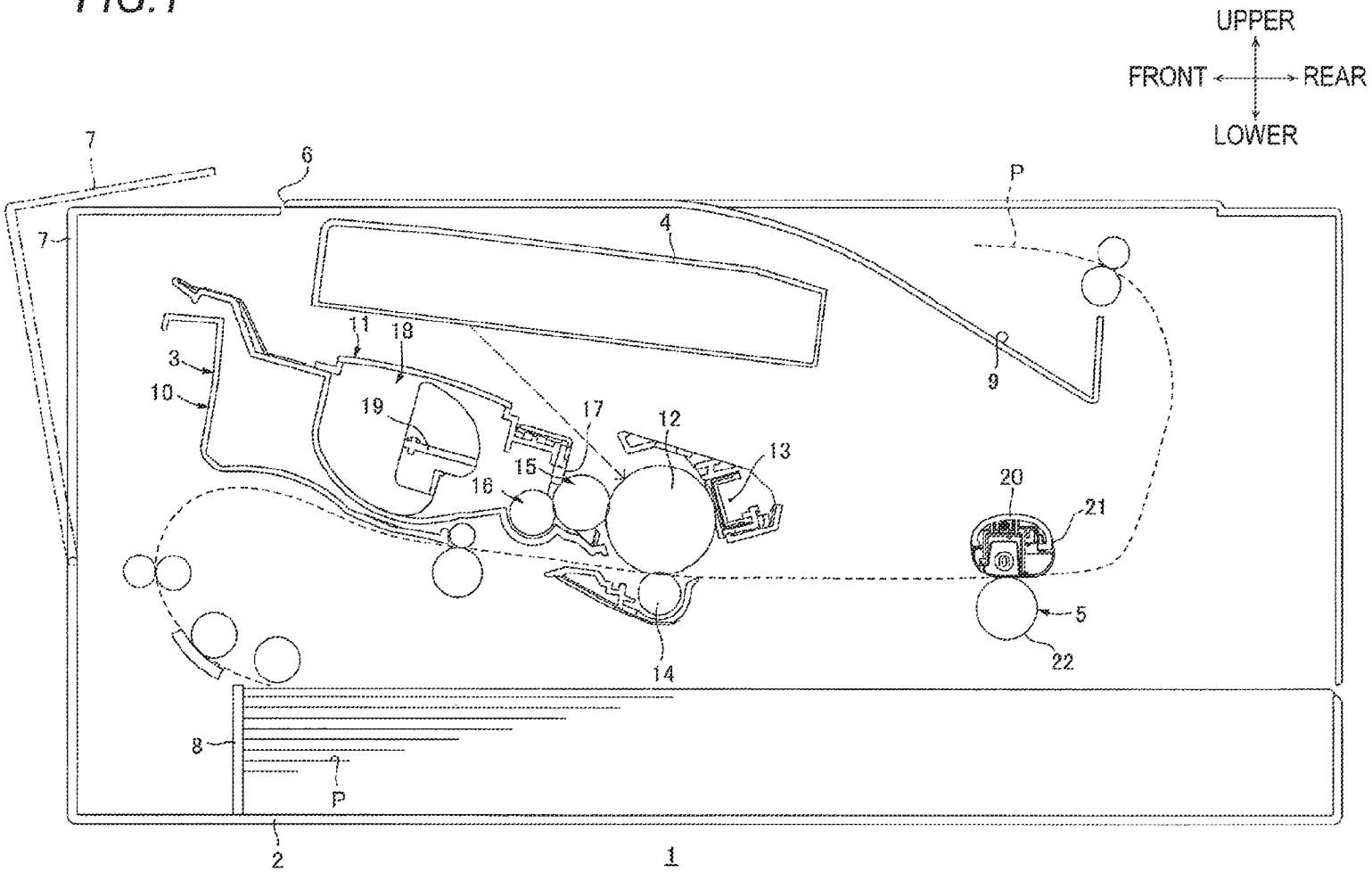
FIG. 1 is a central sectional view of an image forming apparatus to which a fuser unit according to a first illustrative embodiment of the disclosure is mounted.
Figure 6A:
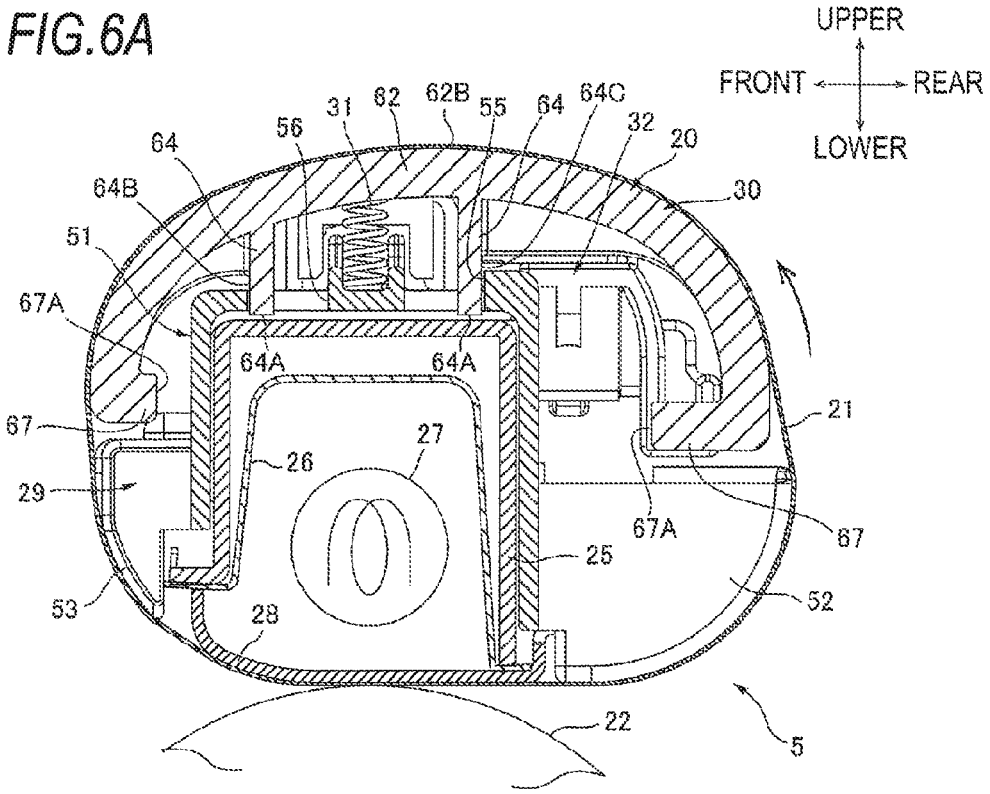
FIG. 6A is a sectional view taken along a line C-C of FIG. 4B, depicting a state where a belt guide is located at a second position.

In below descriptions, directions of the printer 1 are described on the basis of a state where the printer 1 is horizontally placed. That is, the upper side of the drawing sheet of FIG. 1 is the upper side, and the lower side of the drawing sheet is the lower side. Also, the left side of the drawing sheet of FIG. 1 is the front side, and the right side of the drawing sheet of FIG. 1 is the rear side. Also, the left and the right are defined based on a case where the printer 1 is seen from the front. That is, the front side of the drawing sheet of FIG. 1 is the right side, and the inner side of the drawing sheet is the left side. In the meantime, the left-right direction is an example of the first direction, the upper-lower direction is an example of the arrangement direction and the second direction, and the front-rear direction is an example of the third direction. Also, the lower side is an example of one side of the second direction, and the upper side is an example of the other side of the second direction. Also, a direction from the front side towards the rear side in the front-rear direction is a sheet conveying direction, and a direction of an arrow shown in FIG. 6A is a rotating direction of an endless belt 21.

The printer 1 has an apparatus main body 2, a process cartridge 3, a scanner unit 4, and a fuser unit 5.

The apparatus main body 2 has a substantial box shape. The apparatus main body 2 has an opening 6, a front cover 7, a sheet feeding tray 8, and a sheet discharging tray 9.

The opening 6 is arranged at a front end portion of the apparatus main body 2. The opening 6 is configured to enable inside and outside of the apparatus main body 2 to communicate with each other in the front-rear direction so that the process cartridge 3 can pass therethrough.

The front cover 7 is arranged at the front end portion of the apparatus main body 2. The front cover 7 has a plate shape and has a substantially L-shape, as seen from a side sectional view. The front cover 7 is rotatably supported to a front wall of the apparatus main body 2 at a lower-end portion thereof serving as a support point. The front cover 7 is configured to open or close the opening 6.

The sheet feeding tray 8 is arranged at a bottom of the apparatus main body 2. The sheet feeding tray 8 is configured to accommodate sheets P therein.

The sheet discharging tray 9 is arranged on an upper wall of the apparatus main body 2. The sheet discharging tray 9 is downwardly recessed from an upper surface of the apparatus main body 2 so that the sheet P can be placed thereon.

The process cartridge 3 is accommodated at a substantial center of the apparatus main body 2 in the upper-lower direction. The process cartridge 3 is configured to be attached or detached to or from the apparatus main body 2 through the opening 6. The process cartridge 3 has a drum cartridge 10 and a developing cartridge 11.

The drum cartridge 10 has a photosensitive drum 12, a scorotron-type charger 13, and a transfer roller 14.

The photosensitive drum 12 is rotatably supported to a rear end portion of the drum cartridge 10. The photosensitive drum 12 has a substantially cylindrical shape extending in the left-right direction.

The scorotron-type charger 13 is arranged at the rear of the photosensitive drum 12 with being spaced from the photosensitive drum 12.

The transfer roller 14 is arranged below the photosensitive drum 12. The transfer roller 14 is in contact with a lower-end portion of the photosensitive drum 12.

The developing cartridge 11 is mounted to the drum cartridge 10 at the front of the photosensitive drum 12. The developing cartridge 11 has a developing roller 15, a supply roller 16, a layer thickness regulation blade 17, a toner accommodation part 18, and an agitator 19.

The developing roller 15 is rotatably supported to a rear end portion of the developing cartridge 11. The developing roller 15 has a substantial cylinder shape extending in the left-right direction. The developing roller 15 is in contact with a front end portion of the photosensitive drum 12.

The supply roller 16 is arranged at a front lower side of the developing roller 15. The supply roller 16 is rotatably supported to the developing cartridge 11. The supply roller 16 has a substantial cylinder shape extending in the left-right direction. The supply roller 16 is in contact with a front lower-end portion of the developing roller 15.

The layer thickness regulation blade 17 is arranged at a front upper side of the developing roller 15. The layer thickness regulation blade 17 is in contact with a front end portion of the developing roller 15.

The toner accommodation part 18 is arranged at the front of the supply roller 16 and the layer thickness regulation blade 17. The toner accommodation part 18 is configured to accommodate therein toner.

The agitator 19 is rotatably supported in the toner accommodation part 18.

The scanner unit 4 is arranged above the process cartridge 3. The scanner unit 4 is configured to emit a laser beam based on image data towards the photosensitive drum 12.

The fuser unit 5 is arranged at a rear part of the apparatus main body 2. As described in detail later, the fuser unit 5 has an endless belt 21, a heating unit 20 configured to heat the endless belt 21, and a pressing roller 22 arranged below the heating unit 20 so as to interpose the endless belt 21 therebetween.

When the printer 1 starts an image forming operation, the scorotron-type charger 13 uniformly charges a surface of the photosensitive drum 12. The scanner unit 4 exposes the surface of the photosensitive drum 12 on the basis of image data. Thereby, an electrostatic latent image based on the image data is formed on the surface of the photosensitive drum 12.

Also, the agitator 19 stirs the toner in the toner accommodation part 18 and supplies the same to the supply roller 16. The supply roller 16 supplies the toner supplied by the agitator 19 to the developing roller 15. At this time, the toner is positively friction-charged between the developing roller 15 and the supply roller 16, and is carried on the developing roller 15. The layer thickness regulation blade 17 regulates a layer thickness of the toner carried on the developing roller 15 to a predetermined thickness.

Then, the toner carried on the developing roller 15 is supplied to the electrostatic latent image on the surface of the photosensitive drum 12. Thereby, the toner image is carried on the surface of the photosensitive drum 12.

The sheet P is fed one by one between the photosensitive drum 12 and the transfer roller 14 from the sheet feeding tray 8 at a predetermined timing as the various rollers are rotated. The toner image on the surface of the photosensitive drum 12 is transferred to the sheet P when the sheet P passes between the photosensitive drum 12 and the transfer roller 14.

Then, the sheet P is heated and pressed when it passes between the heating unit 20 and the pressing roller 22. Thereby, the toner image on the sheet P is heat-fixed on the sheet P. Thereafter, the sheet P is discharged to the sheet discharging tray 9.

2. Details of Fuser Unit

The fuser unit 5 has the heating unit 20, the endless belt 21 and the pressing roller 22, as described above and as shown in FIGS. 1 and 6A.

(1) Heating Unit

Figure 2:
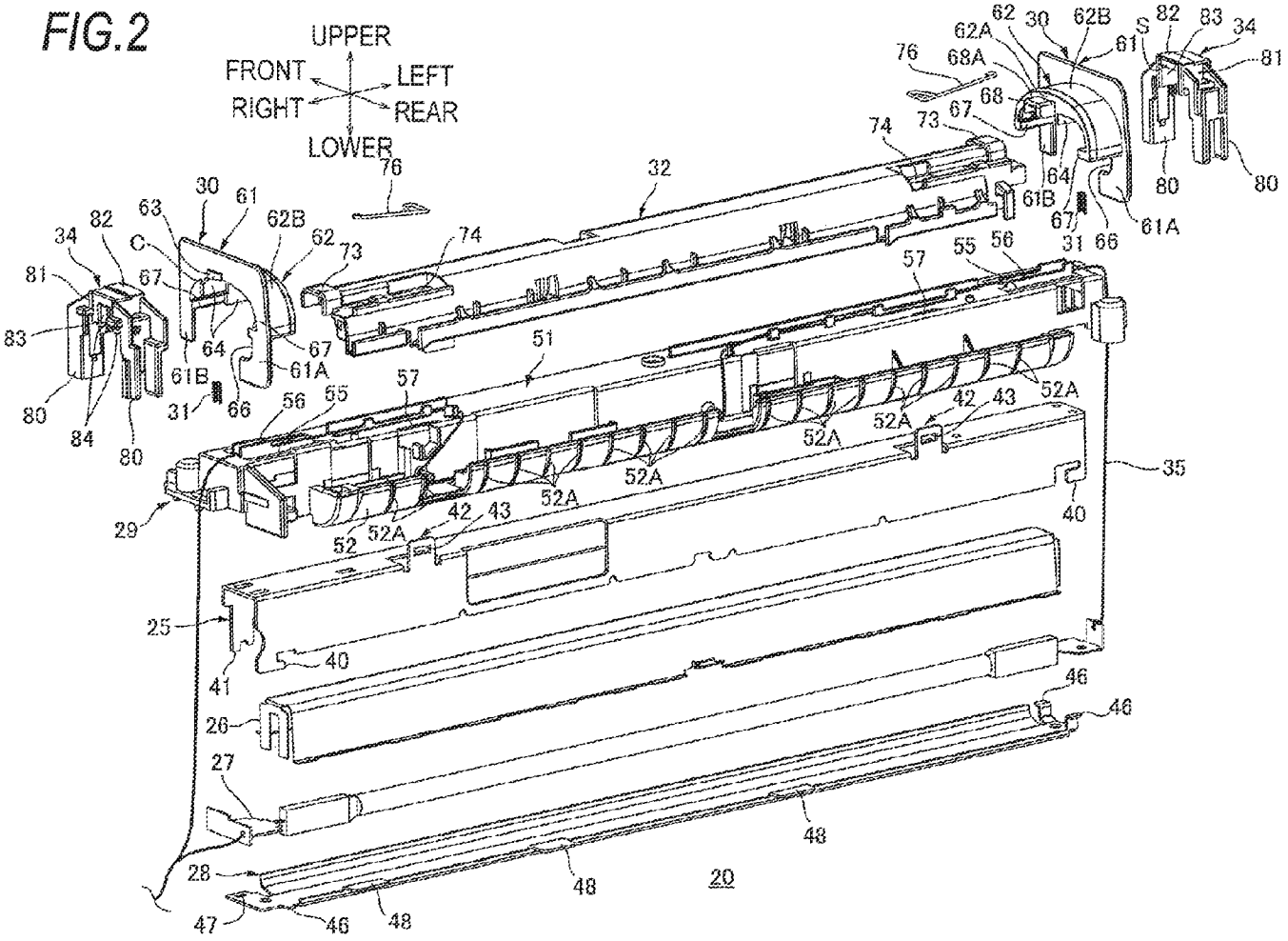
FIG. 2 is an exploded perspective view of a heating unit shown in FIG. 1, as seen from a right upper direction.

As shown in FIGS. 2 and 6A, the heating unit 20 has a stay 25, a reflection plate 26, a halogen heater 27, a nip plate 28 that is an example of the heating plate, a stay cover 29 that is an example of the first frame, a pressing cover 32 that is an example of the second frame, two belt guides 30 that are an example of the first belt guide, two urging members 31, two facing members 34, and a wiring 35.

As shown in FIG. 2, the stay 25 has a substantial square tube shape, which is made of a metal material having high stiffness such as stainless steel and iron, extending in the left-right direction and having an opened lower side. The stay 25 has three hook-shaped parts 40, one extension part 41 and two standing parts 42.

The three hook-shaped parts 40 are respectively arranged at a right-rear lower-end portion, a left-rear lower-end portion and a left-front lower-end portion (not shown) of the stay 25. Each of the three hook-shaped parts 40 extends downwards from a lower-end portion of the stay 25 and is bent inwards in the left-right direction.

The one extension part 41 is arranged at a right-front lower-end portion of the stay 25. The extension part 41 has a substantially rectangular plate shape extending downwards from the lower-end portion of the stay 25, as seen from the front.

The two standing parts 42 are respectively arranged, at an interval in the left-right direction, at a substantial center in the left-right direction of a left side of the stay 25 and at a substantial center in the left-right direction of a right side of the stay 25. Each of the standing parts 42 has a substantially rectangular plate shape extending upwards continuously from a rear wall of the stay 25 and protruding upwards from an upper wall of the stay 25, as seen from the front. The standing parts 42 have a through-hole 43, respectively.

The through-hole 43 penetrates a substantially central portion of the standing part 42 and has a substantially rectangular shape, as seen from the front.

The reflection plate 26 has a substantial square tube shape, which is made of a metal material, extending in the left-right direction and having an opened lower side. An inner surface of the reflection plate 26 is mirror-processed. As shown in FIG. 6A, the reflection plate 26 is arranged inside the stay 25.

As shown in FIGS. 2 and 6A, the halogen heater 27 includes a substantially cylindrical glass tube extending in the left-right direction and having both closed left and right end portions, a filament arranged inside the glass tube and electrodes arranged at both left and right end portions of the glass tube. The halogen heater 27 is configured to generate radiation heat upon energization. As shown in FIG. 6A, the halogen heater 27 is arranged inside the reflection plate 26.

As shown in FIGS. 2 and 6A, the nip plate 28 has a substantially rectangular plate shape made of a metal material and extending in the left-right direction, as seen from a plan view. As shown in FIG. 2, the nip plate 28 has three first claw portions 46, one through-hole 47 and three second claw portions 48.

The three first claw portions 46 are respectively arranged at a right-rear end portion, a left-rear end portion and a left-front end portion of the nip plate 28. The first claw portion 46 arranged at the right-rear end portion protrudes rearwards from the right-rear end portion of the nip plate 28. The first claw portions 46 arranged at the left-rear end portion and the left-front end portion extend upwards from end portions in the front-rear direction and are bent outwards in the front-rear direction at a left end portion of the nip plate 28.

The through-hole 47 is positioned at the right-front end portion of the nip plate 28. The through-hole 47 penetrates the nip plate 28 and has a substantially rectangular shape, as seen from a plan view.

The three second claw portions 48 are arranged, at an interval in the left-right direction, at the rear end portion of the nip plate 28. The second claw portion 48 has a substantially rectangular plate shape protruding rearwards from the rear end portion of the nip plate 28, as seen from a plan view.

The first claw portions 46 are respectively engaged with the corresponding hook-shaped parts 40 of the stay 25 and the one through-hole 47 accommodates the extension part 41 of the stay 25, so that the nip plate 28 is supported to the stay 25 with the reflection plate 26 being interposed therebetween, as shown in FIG. 6A.

Thereby, the nip plate 28 is arranged at the lower-end portion of the heating unit 20, and is configured to be heated by the radiation heat of the halogen heater 27 reflected on the inner surface of the reflection plate 26.

As shown in FIGS. 2 and 6A, the stay cover 29 has a substantial box shape made of a resin material having heat resistance, extending in the left-right direction and having an opened lower-end portion. The stay cover 29 has a covering part 51, a first rubbing part 52 that is an example of the second belt guide, and a second rubbing part 53 that is an example of the second belt guide.

The covering part 51 has a substantial box shape extending in the left-right direction and having an opened lower-end portion. The covering part 51 has two guide grooves 55 that are an example of the groove and the guide part, two holding portions 56 and two first insertion holes 57.

The two guide grooves 55 are respectively arranged at both left and right end portions of an upper wall of the covering part 51. Each of the guide grooves 55 is a groove extending in the left-right direction, penetrating the upper wall of the covering part 51 and having a substantially rectangular shape, as seen from a plan view.

The two holding portions 56 are respectively arranged to extend over the corresponding guide grooves 55 in the left-right direction. Each of the holding portions 56 has a substantial square tube shape extending in the left-right direction and having an opened upper side.

As shown in FIG. 2, the two first insertion holes 57 are respectively arranged, at an interval in the left-right direction, at a substantial center in the left-right direction of a left side of the covering part 51 and at a substantial center in the left-right direction of a right side of the covering part 51. Each of the first insertion holes 57 penetrates a rear end portion of the upper wall of the covering part 51 and has a substantially rectangular plate shape extending in the left-right direction, as seen from a plan view.

Figure 4A:
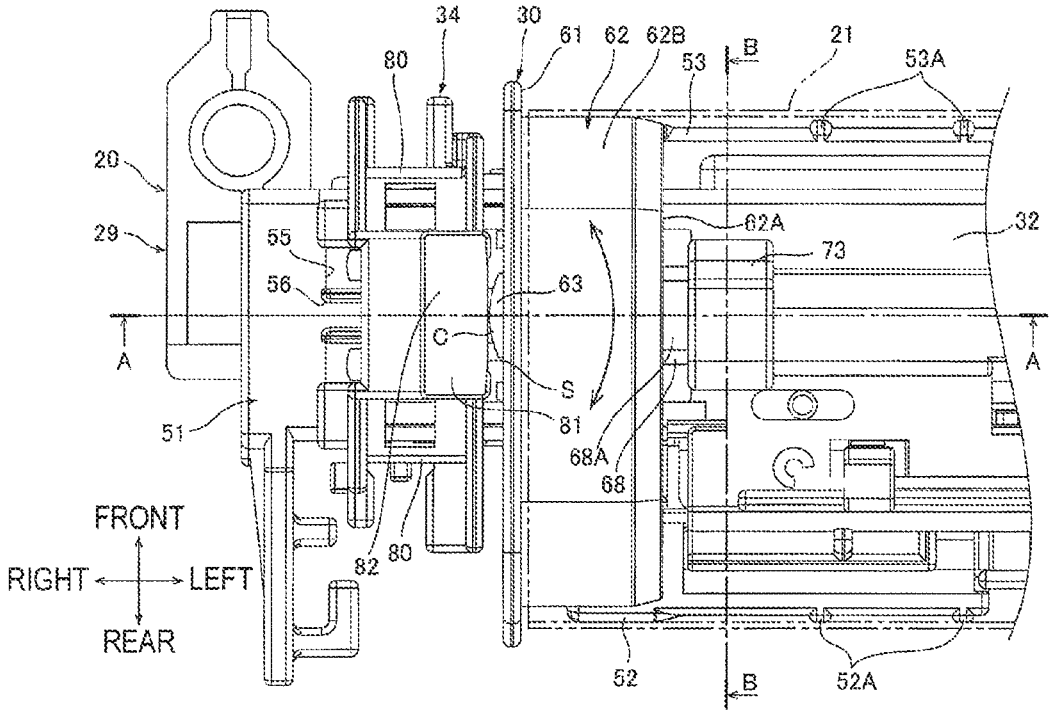
FIG. 4A is a partially enlarged plan view of the heating unit shown in FIG. 3A.

As shown in FIGS. 2 and 6A, the first rubbing part 52 extends to be curved a rear upper direction from a lower-end portion of a rear wall of the covering part 51. The first rubbing part 52 has a partially cylindrical shape extending in the left-right direction, having both closed left and right end portions and having a substantial fan shape as seen from a side. As shown in FIG. 2, a right end portion of the first rubbing part 52 is positioned at the left side of the right end portion of the covering part 51 in the left-right direction and a left end portion of the first rubbing part 52 is positioned at the right side of the left end portion of the covering part 51 in the left-right direction. As shown in FIGS. 2 and 4A, the first rubbing part 52 has a plurality of first guide ribs 52A, which are an example of the guide rib.

The plurality of first guide ribs 52A is arranged at an interval in the left-right direction. Each of the first guide ribs 52A protrudes from an outer circumferential surface of the first rubbing part 52 and extends along a rotating direction of the endless belt 21.

As shown in FIG. 6A, the second rubbing part 53 extends to be curved a front upper direction from a lower-end portion of a front wall of the covering part 51. The second rubbing part 53 has a partially cylindrical shape extending in the left-right direction, having both closed left and right end portions and having a substantial fan shape as seen from a side. In the meantime, although not shown, a right end portion of the second rubbing part 53 is positioned at the left side of the right end portion of the covering part 51 in the left-right direction and a left end portion of the second rubbing part 53 is positioned at the right side of the left end portion of the covering part 51 in the left-right direction. As shown in FIG. 4A, the second rubbing part 53 has a plurality of second guide ribs 53A, which are an example of the guide rib.

The plurality of second guide ribs 53A is arranged at an interval in the left-right direction. Each of the second guide ribs 53A protrudes from an outer circumferential surface of the second rubbing part 53 and extends along the rotating direction of the endless belt 21.

Figures 3A, 3B:
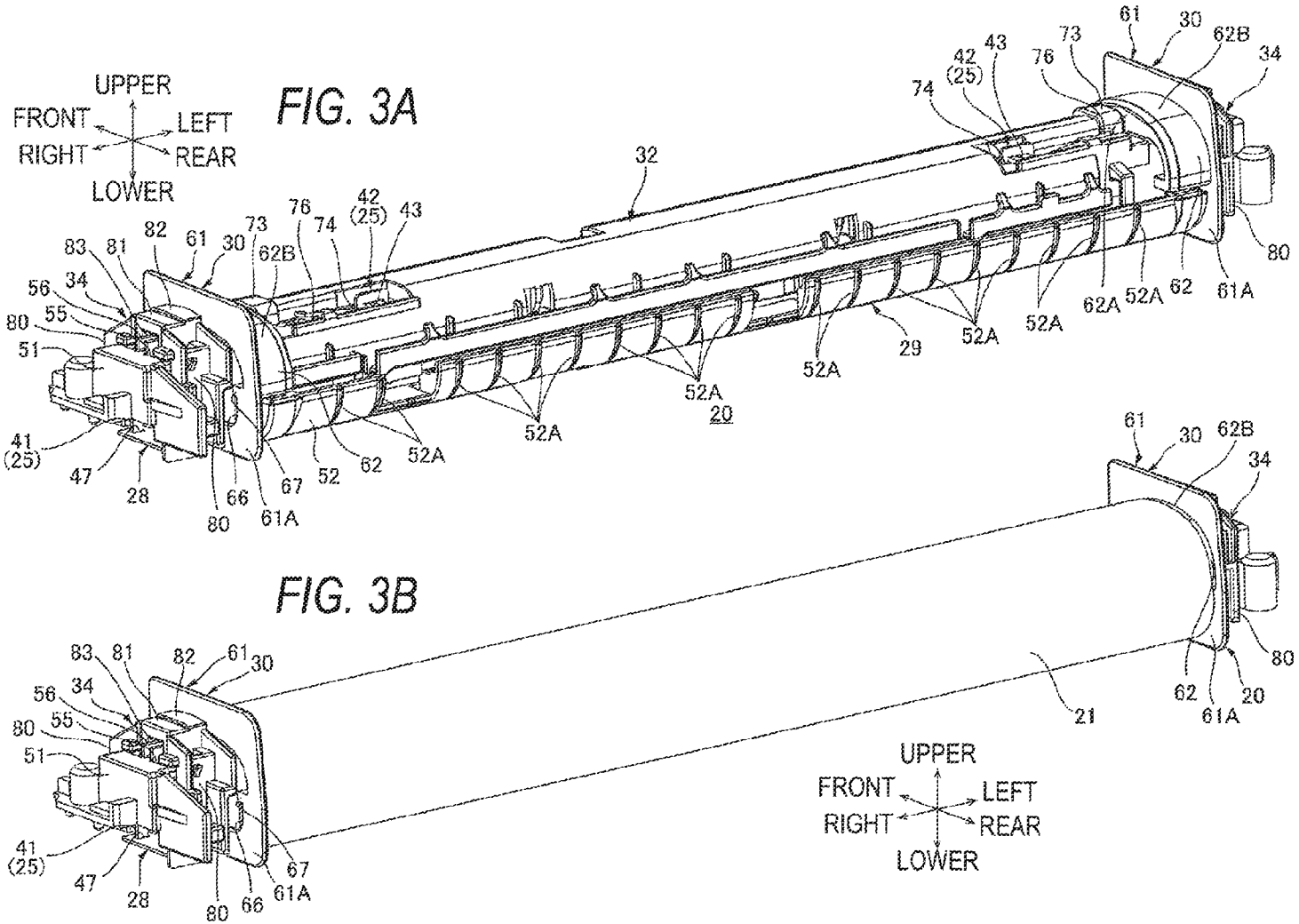
FIG. 3A is a perspective view of the heating unit shown in FIG. 1, as seen from a right upper direction.
FIG. 3B is a perspective view of the heating unit having an endless belt of FIG. 1 wound thereto, as seen from the right upper direction.

As shown in FIGS. 3A and 6A, the stay cover 29 is configured to accommodate the stay 25, the reflection plate 26, the halogen heater 27 and the nip plate 28 in the covering part 51. At this time, the three second claw portions 48 of the nip plate 28 are engaged with engaged portions (not shown) of the covering part 51 of the stay cover 29, and the two standing parts 42 of the stay 25 are respectively inserted into the corresponding first insertion holes 57 from below, so that the stay 25, the reflection plate 26, the halogen heater 27 and the nip plate 28 are positioned with respect to the stay cover 29.

As shown in FIGS. 2 and 3A, the pressing cover 32 has a substantial square tube shape made of the same material as the stay cover 29, extending in the left-right direction and having an opened lower side. The pressing cover 32 has two pressing parts 73, which are an example of the portion to be engaged, and two second insertion holes 74.

The two pressing parts 73 are respectively arranged at both left and right end portions of an upper wall of the pressing cover 32. Each of the pressing parts 73 has a substantial square tube shape extending in the left-right direction and having an opened lower side.

The two second insertion holes 74 are respectively arranged, at an interval in the left-right direction, at a substantial center in the left-right direction of a left side portion of the pressing cover 32 and at a substantial center in the left-right direction of a right side portion of the pressing cover 32. Each of the second insertion holes 74 penetrates a rear end portion of the upper wall of the pressing cover 32 and has a substantially rectangular plate shape and extending in the left-right direction and, as seen from a plan view.

Figure 5A:
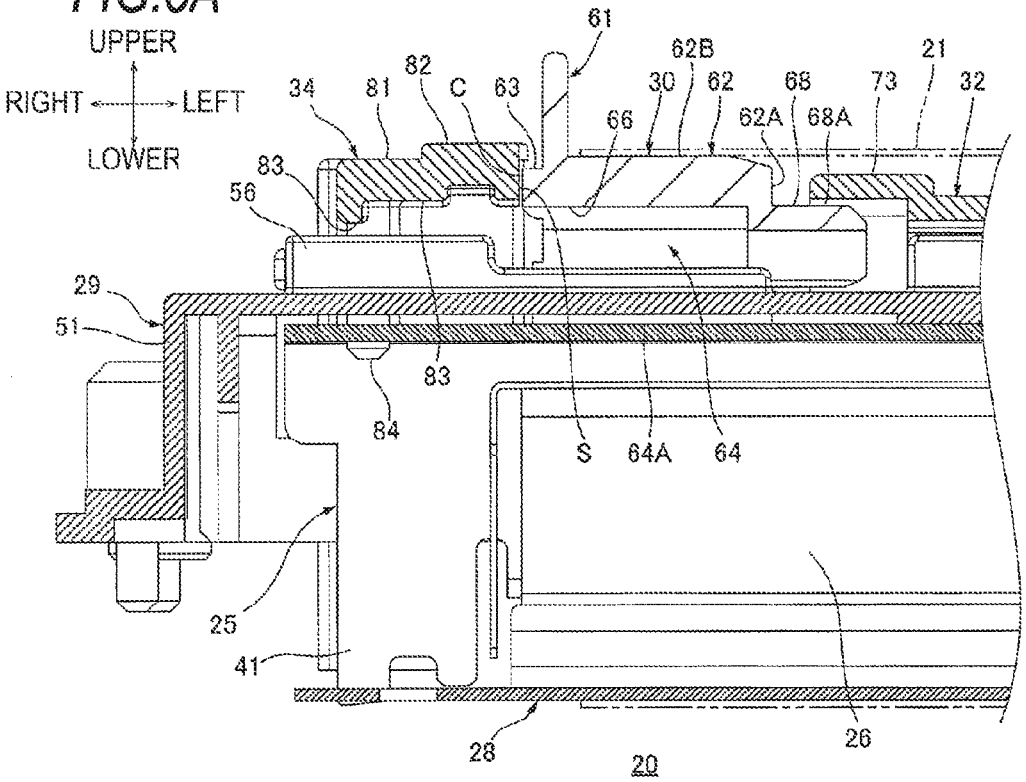
FIG. 5A is a sectional view taken along a line A-A of FIG. 4A.

As shown in FIGS. 3A and 5A, the pressing cover 32 is mounted to the stay cover 29 with accommodating the covering part 51 of the stay cover 29.

Also, as shown in FIG. 2, each of the two second insertion holes 74 overlaps with the corresponding first insertion hole 57 of the stay cover 29 in the upper-lower direction. Thereby, as shown in FIG. 3A, the two standing parts 42 of the stay 25 are respectively inserted into the corresponding second insertion holes 74 from below.

Two fixation pins 76 made of a wire material are respectively inserted into the through-holes 43 of the corresponding standing parts 42, so that the pressing cover 32 is fixed to the stay 25 with interposing the stay cover 29.

In the meantime, the stay cover 29 and the pressing cover 32 are configured as an example of the frame.

The two belt guides 30 are respectively arranged at outer sides of the pressing cover 32 in the left-right direction. As shown in FIGS. 2 and 3A, each of the belt guides 30 integrally has a restraining part 61, an inner surface guide 62, an engaging part 68, a protrusion 63, and two guide protrusions 64, which are an example of the guided part and the protrusion.

As shown in FIG. 2, the restraining part 61 has a substantially rectangular plate shape having a thickness in the left-right direction, as seen from a side. The restraining part 61 has a first restraining part 61A, a second restraining part 61B and a recess portion 66.

Figure 5B:
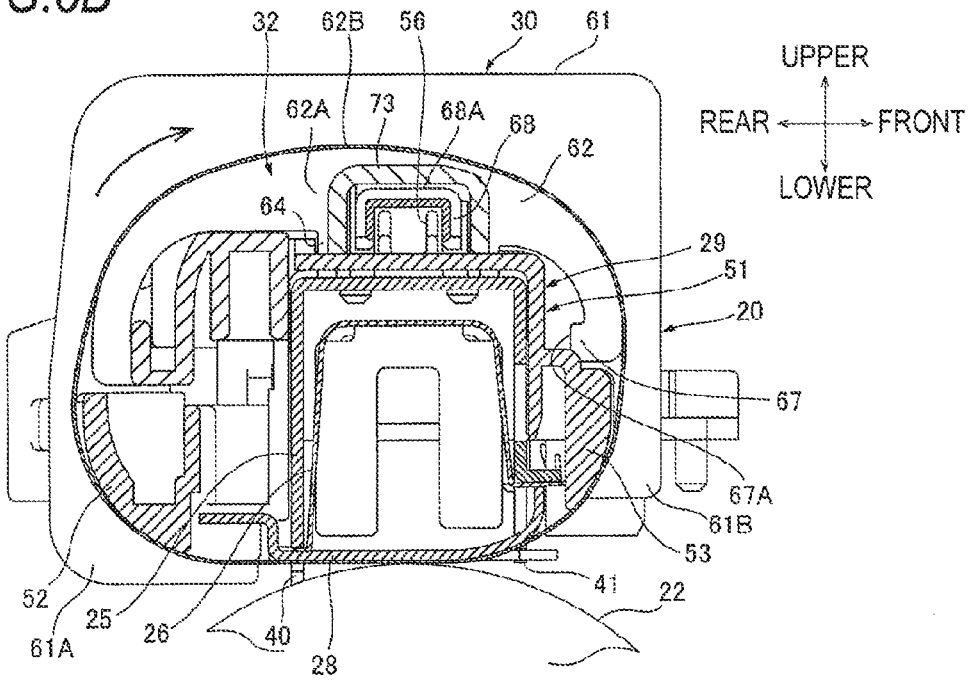
FIG. 5B is a sectional view taken along a line B-B of FIG. 4A.

As shown in FIGS. 2 and 5B, the first restraining part 61A is arranged at a downstream side with respect to the sheet conveying direction, i.e., at a rear end portion of the restraining part 61. The first restraining part 61A has a substantially L-shaped plate shape extending downwards and bent forwards, as seen from a side.

The second restraining part 61B is arranged at an upstream side with respect to the sheet conveying direction, i.e., at a front end portion of the restraining part 61. The second restraining part 61B has a substantially rectangular plate shape extending downwards, as seen from a side.

As shown in FIG. 2, the recess portion 66 is notched into a substantial U shape having an opened lower side from a lower end edge to a substantially central portion of the restraining part 61, as seen from a side. A size of the recess portion 66 in the front-rear direction is greater than a size of the covering part 51 of the stay cover 29 in the front-rear direction.

The inner surface guide 62 has a substantially semi-cylindrical shape connected to the restraining part 61, extending inwards in the left-right direction from an inner surface in the left-right direction of the restraining part 61 at an upper side of a substantial center in the upper-lower direction and having an opened lower side. That is, the first restraining part 61A and second restraining part 61B of the restraining part 61 are arranged at positions closer to the first rubbing part 52 and the second rubbing part 53 than the inner surface guide 62 in the upper-lower direction. In the meantime, an inner end surface 62A of the inner surface guide 62 in the left-right direction is configured as an example of the second surface, and an outer circumferential surface 62B of the inner surface guide 62 is configured as an example of the fourth surface. Also, the inner surface guide 62 has two folded-back parts 67.

As shown in FIGS. 2 and 6A, the two folded-back parts 67 extend from both outer lower-end portions in the front-rear direction of the inner surface guide 62 towards an inner side in the front-rear direction, respectively. In the meantime, an inner end surface 67A in the front-rear direction of the front folded-back part 67 is configured as an example of the fifth surface, and an inner end surface 67A in the front-rear direction of the rear folded-back part 67 is configured as an example of the sixth surface.

As shown in FIGS. 2 and 5A, the engaging part 68 protrudes from an inner surface in the left-right direction of a substantial center in the front-rear direction of the upper-end portion of the inner surface guide 62 towards an inner side in the left-right direction. As shown in FIGS. 5A and 5B, the engaging part 68 has a substantial square tube shape having an opened lower side. A size of the engaging part 68 in the front-rear direction is smaller than a size of the pressing part 73 in the front-rear direction.

As shown in FIGS. 2 and 4A, the protrusion 63 is arranged above the recess portion 66 of the restraining part 61. The protrusion 63 protrudes outwards from an outer surface in the left-right direction of the restraining part 61 and has a curved surface C curved inwardly in the left-right direction as it faces from a center in the front-rear direction towards an outer side in the front-rear direction, as seen from above.

The curved surface C is a curved surface configured by a plurality of continuous surfaces having different angles, and is configured as an example of the first surface.

As shown in FIGS. 2 and 6A, the two guide protrusions 64 are arranged at an interval each other in the front-rear direction at a substantial center of the belt guide 30 in the front-rear direction. The guide protrusions 64 protrude downwardly from a substantial center in the front-rear direction of the inner surface of the inner surface guide 62 and from a substantial center in the front-rear direction of the inner circumferential surface of the restraining part 61. The guide protrusion 64 is a rib extending in the left-right direction and having a substantially rectangular plate shape, as seen from the front. In the meantime, the interval between the two guide protrusions 64 in the front-rear direction is greater than a size of the holding portion 56 in the front-rear direction and smaller than a size of the guide groove 55 in the front-rear direction. Meanwhile, a lower surface 64A of the guide protrusion 64 is configured as an example of the third surface. Also, a front surface 64B of the front guide protrusion 64 is configured as an example of the fifth surface, and a rear surface 64C of the rear guide protrusion 64 is configured as an example of the sixth surface.

The two belt guides 30 are respectively mounted to the stay cover 29 so that the guide protrusions 64 thereof are accommodated in the guide grooves 55 of the stay cover 29 and the engaging parts 68 are accommodated in the corresponding pressing parts 73 of the pressing cover 32.

Thereby, the front surface 64B of the front guide protrusion 64 faces a front end edge of the guide groove 55 and the rear surface 64C of the rear guide protrusion 64 faces a rear end edge of the guide groove 55.

Also, as shown in FIGS. 3A and 6A, the rear lower-end portion of the inner surface guide 62 of the belt guide 30 faces the upper-end portion of the first rubbing part 52 in the upper-lower direction, and the front lower-end portion of the inner surface guide 62 faces the upper-end portion of the second rubbing part 53 in the upper-lower direction.

Also, as shown in FIG. 5B, the first restraining part 61A of the belt guide 30 faces the end portion in left-right direction of the first rubbing part 52 in the left-right direction, and the second restraining part 61B faces the end portion in left-right direction of the second rubbing part 53 in the left-right direction. In the meantime, the lower-end portion of the first restraining part 61A is located at a position lower than the nip plate 28, and overlaps with the rear end portion of the nip plate 28, as seen from the left-right direction. Also, the lower-end portion of the second restraining part 61B is located at a front upper position of the front end portion of the nip plate 28, as seen from the left-right direction.

As shown in FIG. 6A, the lower surface 64A of the guide protrusion 64 faces the upper wall of the stay 25 in the upper-lower direction.

Also, as shown in FIG. 5A, the upper surface 68A of the engaging part 68 faces the upper wall of the pressing parts 73 in the upper-lower direction.

Also, as shown in FIG. 5B, both ends of the engaging part 68 in the front-rear direction face the inner surface of the pressing part 73 at a slight interval in the front-rear direction.

Also, as shown in FIG. 5A, the inner end surface 62A of the inner surface guide 62 faces the outer end portion in the left-right direction of the pressing part 73, in the left-right direction.

Also, as shown in FIG. 6A, the inner end surface 67A of each of the two folded-back parts 67 faces the outer end surface of the covering part 51 of the stay cover 29, in the front-rear direction. In other words, the inner end surfaces 67A of the two folded-back parts 67 face each other to sandwich the stay cover 29 in the front-rear direction.

In this way, the belt guide 30 is configured to be moveable so that it is guided to a first position (refer to FIG. 6B) at which the lower surfaces 64A of the guide protrusions 64 are contacted to the upper wall of the stay 25 and to a second position (refer to FIG. 6A) at which the lower surfaces 64A of the guide protrusions 64 are spaced from the upper wall of the stay 25 by the guide groove 55.

As shown in FIGS. 2 and 6A, the two urging members 31 are respectively arranged at both left and right end portions of the heating unit 20 and at a substantial center of the heating unit 20 in the front-rear direction. The urging member 31 is a coil spring of which a wire material is spirally wound along the upper-lower direction. The urging member 31 is arranged between the two guide protrusions 64. The urging member 31 is accommodated so that a lower-end portion thereof is contacted to the upper surface of the holding portion 56, and an upper-end portion thereof is contacted to the inner circumferential surface of the inner surface guide 62 of the belt guide 30. Thereby, the urging member 31 is configured to urge the belt guide 30 upwards all the time. In other words, the urging member 31 is configured to urge a substantial center in the front-rear direction of the inner circumferential surface of the inner surface guide 62 of the belt guide 30, and to urge the belt guide 30 upwards, i.e., in a direction of getting away from the pressing roller 22 along the arrangement direction of the heating unit 20 and the pressing roller 22. That is, the guide groove 55 guides the movement of the belt guide 30 when the belt guide 30 is urged from the first position to the second position by the urging member 31.

Figure 4B:
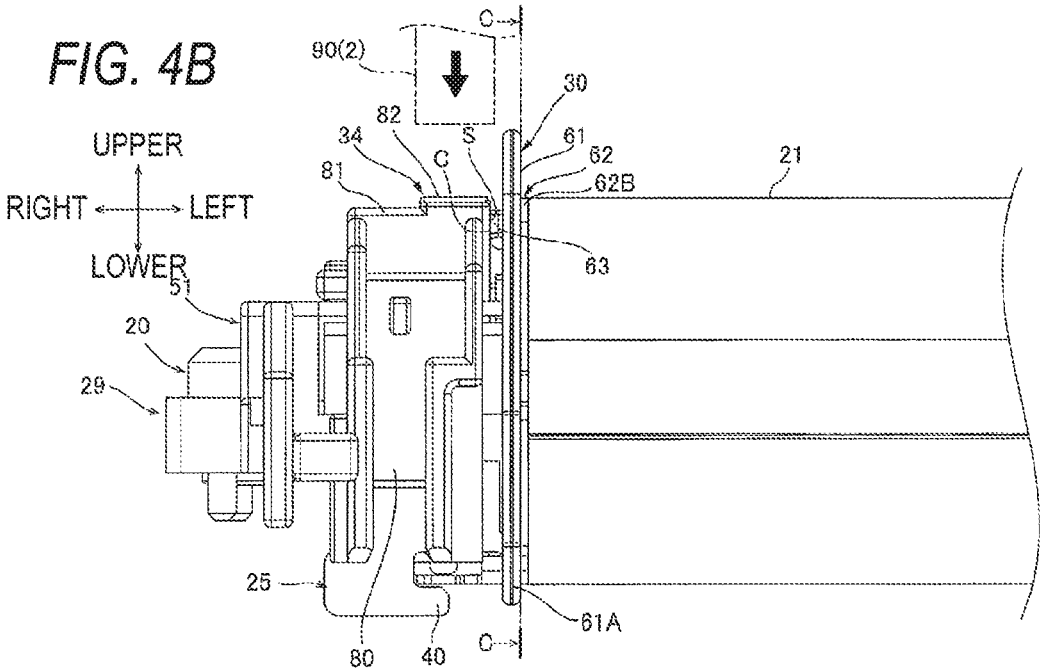
FIG. 4B is a partially enlarged rear view of the heating unit having the endless belt of FIG. 3B wound thereto.

As shown in FIG. 3A, in the heating unit 20, the two facing members 34 are arranged at the outer positions of the corresponding belt guides 30 in the left-right direction. In the meantime, as shown in FIG. 4B, the facing member 34 is configured to press the nip plate 28 towards the pressing roller 22, by a pressing force from a pressing mechanism 90 provided for the apparatus main body 2. As shown in FIG. 2, the facing member 34 has two leg parts 80 and a coupling part 81.

The two leg parts 80 are arranged at an interval in the front-rear direction. The leg part 80 has a substantially prismatic shape extending in the upper-lower direction. The interval between the two leg parts 80 in the front-rear direction is greater than the size of the covering part 51 of the stay cover 29 in the front-rear direction.

The coupling part 81 is configured to couple upper-end portions of the leg parts 80. The coupling part 81 has a substantially prismatic shape extending in the front-rear direction. The coupling part 81 has a receiving portion 82, an accommodation portion 83 and two positioning protrusions 84.

The receiving portion 82 protrudes upwards from an inner side in the left-right direction of the coupling part 81 at a substantial center thereof in the front-rear direction. The receiving portion 82 has a substantial arc shape, as seen from a side. That is, a circumferential surface of the receiving portion 82 has a curved shape. The receiving portion 82 is configured to receive the pressing force from the pressing mechanism 90 of the apparatus main body 2.

The accommodation portion 83 is recessed upwards from a substantial center in the front-rear direction of the coupling part 81.

The two positioning protrusions 84 are arranged at an interval each other so as to extend over the accommodation portion 83 in the front-rear direction. The positioning protrusion 84 has a substantial cylinder shape protruding downwards from a lower surface of the coupling part 81. In the meantime, the interval between the two positioning protrusions 84 in the front-rear direction is greater than the size of the holding portion 56 in the front-rear direction and smaller than the size of the guide groove 55 in the front-rear direction.

Also, an inner surface in the left-right direction of the facing member 34 above the accommodation portion 83 is configured as a contact surface S that is an example of the contact surface. The contact surface S has a planar shape.

As shown in FIG. 4A, the two facing members 34 are arranged to face the outer sides of the corresponding belt guides 30 in the left-right direction. Specifically, as shown in FIG. 2, the facing member 34 is mounted to the stay cover 29 so that it interposes the covering part 51 of the stay cover 29 by the two leg parts 80 in the front-rear direction, the accommodation portion 83 accommodates the holding portion 56 and the two positioning protrusions 84 are inserted into the guide groove 55.

Also, as shown in FIGS. 4A and 4B, the facing member 34 is arranged at a slight interval from the restraining part 61 of the belt guide 30, and is contacted at the contact surface S to the curved surface C of the protrusion 63 of the belt guide 30 in the left-right direction.

As shown in FIG. 2, the wiring 35 is a conductive wire extending from the right side of the heating unit 20 and configured to feed power to the halogen heater 27. The wiring 35 is connected to the electrodes provided at both left and right end portions of the halogen heater 27 while passing between the stay cover 29 and the pressing cover 32.

(2) Endless Belt

As shown in FIGS. 3B and 6A, the endless belt 21 is a film having heat resistance and flexibility and has a cylindrical shape extending in the left-right direction. The endless belt 21 is wound around the heating unit 20 so that an inner surface thereof is contacted to the lower surface of the nip plate 28, and is configured to circulate in a counterclockwise direction, as seen from a right side.

Also, a rear lower-end portion of the endless belt 21 is contacted to the circumferential surface of the first rubbing part 52 so that it is guided thereto, and a front lower-end portion of the endless belt 21 is contacted to the circumferential surface of the second rubbing part 53 so that it is guided thereto.

Upper-end portions of both left and right ends of the endless belt 21 are contacted to the outer circumferential surfaces 62B of the inner surface guides 62 of the belt guides 30. That is, the inner surface guides 62 are upwardly urged by the urging members 31, so that the endless belt 21 is applied with tension.

In the meantime, both left and right end portions of the endless belt 21 face the inner surfaces of the restraining parts 61 of the belt guides 30 in the left-right direction.

(3) Pressing Roller

As shown in FIG. 1, the pressing roller 22 has a substantial cylinder shape made of a material having elasticity such as rubber and extending in the left-right direction. The pressing roller 22 is contacted to the outer circumferential surface of the endless belt 21 so that the endless belt 21 is interposed between the pressing roller and the nip plate 28 of the heating unit 20. The pressing roller 22 is supported to the apparatus main body 2 so that it is rotated in a clockwise direction, as seen from a right side, when a driving force from a driving source (not shown) is input thereto.

3. Assembling of Heating Unit and Endless Belt

In order to assemble the heating unit 20 and the endless belt 21, the reflection plate 26 and the halogen heater 27 are first arranged in the stay 25, as shown in FIG. 6A.

Then, the three first claw portions 46 of the nip plate 28 are respectively engaged with the corresponding hook-shaped parts 40 of the stay 25, and the extension part 41 of the stay 25 is accommodated in the through-hole 47 of the nip plate 28.

Thereby, the reflection plate 26, the halogen heater 27 and the nip plate 28 are mounted to the stay 25.

Then, as shown in FIGS. 2 and 3A, the stay cover 29 is mounted to the stay 25 so that the corresponding standing parts 42 of the stay 25 are respectively inserted into the two first insertion holes 57.

Then, the wiring 35 is disposed above the upper wall of the stay cover 29 and is connected to the electrodes provided at both left and right end portions of the halogen heater 27.

Then, the pressing cover 32 is mounted to the stay cover 29 so that the wiring 35 is interposed between the pressing cover and the stay cover 29 and the corresponding standing parts 42 of the stay 25 are respectively inserted into the two second insertion holes 74.

Then, the two fixation pins 76 are respectively inserted into the through-holes 43 of the corresponding standing parts 42 of the stay 25. Thereby, the pressing cover 32 is fixed to the stay 25 with the stay cover 29 being interposed therebetween.

Then, as shown in FIGS. 3B and 4A, the mounted stay 25, the reflection plate 26, the halogen heater 27, the nip plate 28, the stay cover 29 and the pressing cover 32 are inserted into the endless belt 21 from the outer side in the left-right direction.

At this time, the endless belt 21 is mounted so that the right end portion of the endless belt 21 is disposed at the right of the right end portion of the pressing cover 32 and the left end portion of the endless belt 21 is disposed at the left of the left end portion of the pressing cover 32.

Then, the two belt guides 30 and the two urging members 31 are mounted to the stay cover 29 so that they are positioned at the outer sides of the endless belt 21 with respect to the left-right direction.

Specifically, as shown in FIGS. 2 and 6A, the belt guide 30 is mounted to the stay cover 29 so that the urging member 31 is disposed in the holding portion 56 and the two guide protrusions 64 of the belt guide 30 are fitted to the outer end portions in the left-right direction of the guide groove 55.

Then, the belt guide 30 is slid inwardly in the left-right direction so that the two guide protrusions 64 are guided to the guide groove 55.

Thereby, as shown in FIG. 5A, the inner surface guide 62 is arranged in the endless belt 21, the outer circumferential surface 62B of the inner surface guide 62 is contacted to the inner circumferential surface of the endless belt 21 and the engaging part 68 of the belt guide 30 is accommodated in the pressing part 73.

Then, as shown in FIG. 3A, the two facing members 34 are disposed at the outer sides of the corresponding belt guides 30 in the left-right direction and mounted to the stay cover 29 from above.

Thereby, the covering part 51 of the stay cover 29 is interposed between the two leg parts 80 in the front-rear direction, and the two positioning protrusions 84 are inserted into the outer end portions in the left-right direction of the guide groove 55, so that the belt guide 30 is positioned with respect to the stay cover 29.

Thereby, as shown in FIGS. 4A and 4B, the curved surface C of the protrusion 63 of the belt guide 30 is contacted to the contact surface S of the facing member 34.

By the above, the assembling of the heating unit 20 and the endless belt 21 is completed.

4. Operations of Fuser Unit

In the above image forming operation, the endless belt 21 between the nip plate 28 and the pressing roller 22 is heated by the nip plate 28 that is subject to the high temperature by the radiation heat of the halogen heater 27.

Figure 6B:
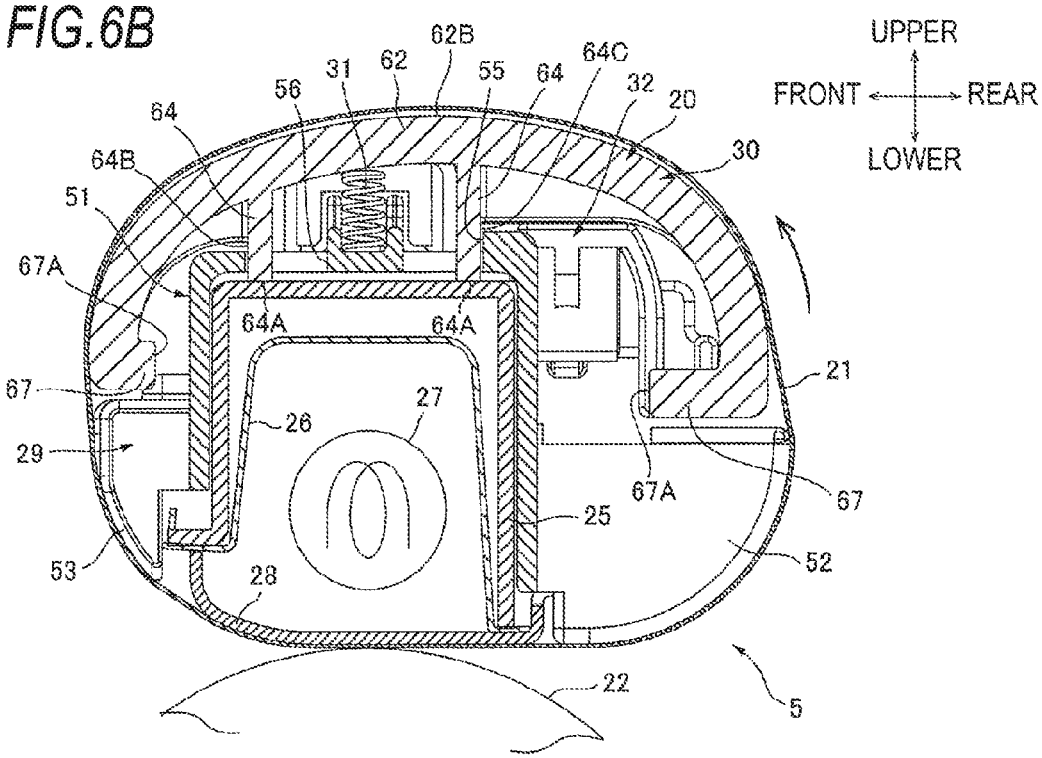
FIG. 6B is a sectional view taken along a line C-C of FIG. 4B, depicting a state where the belt guide is located at a first position.

When the image forming operation starts, the pressing roller 22 is rotated in the clockwise direction, as seen from a right side, by the driving force from the apparatus main body 2, as shown in FIGS. 6A and 6B. Then, the endless belt 21 circulates in the counterclockwise direction, as seen from a right side, as the pressing roller 22 is rotated. That is, the endless belt 21 is moved rearwards between the nip plate 28 and the pressing roller 22.

At this time, the endless belt 21 may deviate in the left-right direction due to the passing of the sheet P between the endless belt 21 and the pressing roller 22 and a pressure difference of the pressing roller 22 in the left-right direction.

When the endless belt 21 deviates in the left-right direction, both left and right end portions of the endless belt 21 may circulate with being in contact with the inner surfaces in the left-right direction of the restraining parts 61 of the belt guides 30, as shown in FIGS. 4A and 4B.

In this case, the curved surface C of the protrusion 63 of the belt guide 30 is contacted to the contact surface S of the coupling part 81 of the facing member 34, so that the belt guide 30 swings at a contact part serving as a support point between the contact surface S and the curved surface C, as seen from a plan view.

In the meantime, as shown in FIG. 6A, the belt guide 30 is always urged upwardly by the urging member 31, so that the belt guide swings, as seen from a plan view, without moving in the upper-lower direction.

5. Operational Effects

According to the fuser unit disclosed in background art, only the moveable wall is moved relative to the inner surface guide and the restraining part. Therefore, it is necessary to provide the restraining part even at the position of the film, which is stretched by the movement of the moveable wall, so that the fuser unit is enlarged.

The disclosure provides a fuser unit capable of suppressing the fuser unit from being enlarged.

The fuser unit according to this disclosure will obtain following effects.

(1) According to the fuser unit 5, as shown in FIG. 6A, the inner surface guide 62 of the belt guide 30 is urged towards the inner circumferential surface of the endless belt 21 by the urging member 31. Therefore, it is possible to apply the tension to the endless belt 21, thereby suppressing the endless belt 21 from being deflected.

Therefore, while it is possible to suppress the endless belt 21 from being deflected, it is possible to securely guide the end portion in the left-right direction of the endless belt 21 by the inner surface guide 62 of the belt guide 30. Therefore, it is possible to stably circulate the endless belt 21.

Also, as shown in FIG. 2, since the restraining part 61 is connected to and integrally formed with the inner surface guide 62, the restraining part is moved together with the inner surface guide 62 by the urging force of the urging member 31. Therefore, it is possible to enable the restraining part 61 and the end portion of the endless belt 21 to face each other all the time.

Therefore, it is possible to minimize the restraining part 61, so that it is possible to suppress the fuser unit 5 from being enlarged.

(2) Also, according to the fuser unit 5, as shown in FIG. 6A, the inner surface guide 62 is urged to be spaced from the pressing roller 22 along the arrangement direction of the nip plate 28 and the pressing roller 22 by the urging member 31, so that the tension is applied to the endless belt 21.

That is, since it is possible to apply the tension to a part of the endless belt 21, which is easily bent, i.e., a part of the endless belt 21 not sandwiched by the nip plate 28 and the pressing roller 22, it is possible to securely suppress the endless belt 21 from being deflected.

(3) Also, according to the fuser unit 5, as shown in FIG. 6A, the stay cover 29 has the guide groove 55 that guides the movement of the belt guide 30 when the belt guide 30 is urged. Therefore, the guide protrusion 64 of the belt guide 30 is guided to the guide groove 55, so that the belt guide 30 can be moved in the upper-lower direction.

Therefore, it is possible to securely urge the inner surface guide 62 by the urging of the urging member 31 so that it is spaced from the pressing roller 22 along the upper-lower direction.

(4) Also, according to the fuser unit 5, as shown in FIGS. 2 and 6A, the guide protrusion 64 is inserted into the guide groove 55. By this simple configuration, it is possible to securely guide the belt guide 30 to the stay cover 29.

(5) Also, according to the fuser unit 5, as shown in FIGS. 2 and 6A, the guide protrusion 64 is the rib extending in the left-right direction. Therefore, when the belt guide 30 is urged, it is possible to stabilize a posture of the belt guide 30.

Therefore, it is possible to more securely guide the belt guide 30 to the stay cover 29.

(6) Also, according to the fuser unit 5, as shown in FIG. 6A, the two guide protrusions 64 are provided. Thereby, it is possible to more stabilize the posture of the belt guide 30 when the belt guide 30 is urged.

(7) Also, according to the fuser unit 5, as shown in FIG. 6A, since the urging member 31 is arranged between the two guide protrusions 64, it is possible to stably urge the belt guide 30.

(8) Also, according to the fuser unit 5, as shown in FIGS. 2 and 6B, since the stay 25 is made of the metal material, it has high stiffness.

Therefore, when the belt guide 30 is located at the first position, the guide protrusion 64 is contacted to the stay 25, so that it is possible to restrain the belt guide 30 from being moved more downwards than the stay 25.

(9) Also, according to the fuser unit 5, as shown in FIG. 6A, the urging member 31 is arranged between the stay 25 and the inner surface guide 62. By this simple configuration, it is possible to urge the inner surface guide 62, thereby applying the tension to the endless belt 21.

Therefore, it is possible to easily suppress the endless belt 21 from being deflected.

(10) Also, according to the fuser unit 5, as shown in FIG. 6A, the substantial center of the inner surface guide 62 is urged by the urging member 31, so that the tension can be efficiently applied to the endless belt 21.

(11) Also, according to the fuser unit 5, as shown in FIGS. 2 and 6A, the urging member 31 is configured by the spring. By this simple configuration, it is possible to urge the inner surface guide 62, thereby applying the tension to the endless belt 21.

(12) Also, according to the fuser unit 5, as shown in FIGS. 2 and 6A, it is possible to indirectly heat the nip plate 28 by the halogen heater 27 without providing the nip plate 28 with a configuration such as a heat transfer line.

6. Second Illustrative Embodiment

Figure 7:
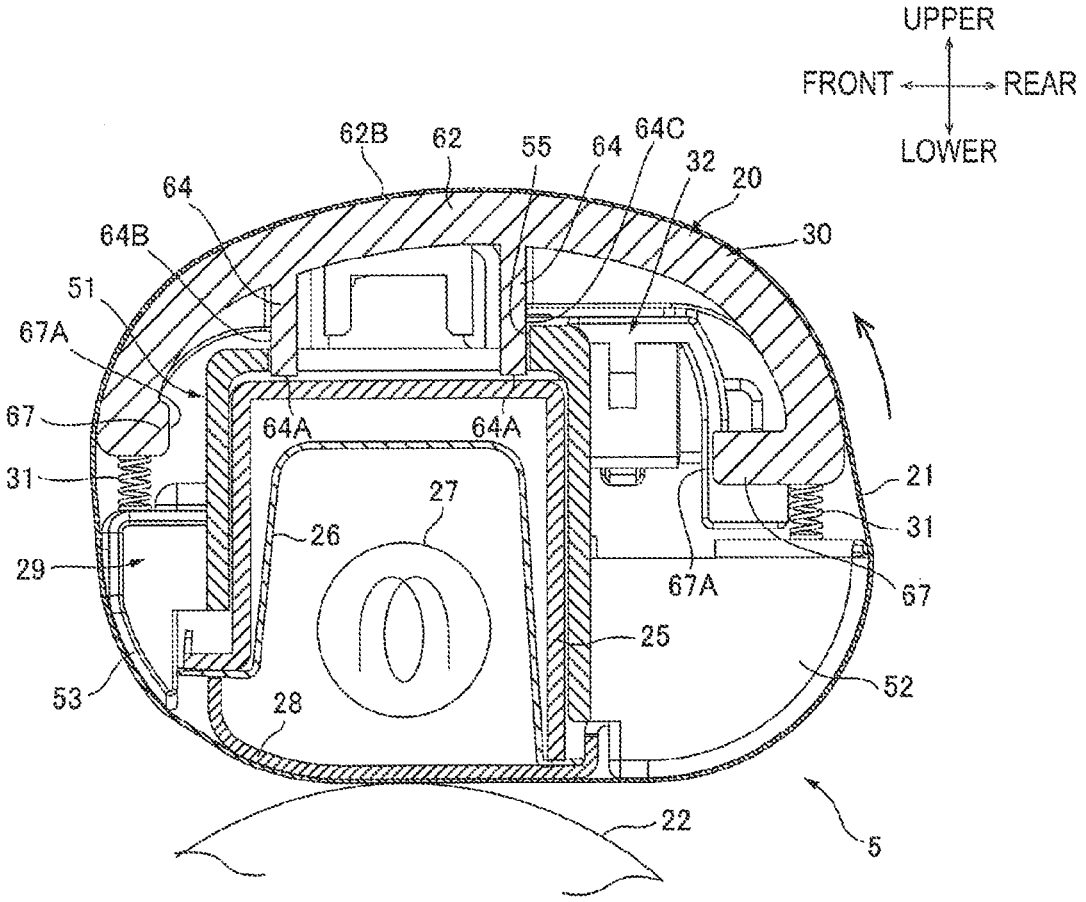
FIG. 7 is a sectional view of a fuser unit according to a second illustrative embodiment.

A second illustrative embodiment of the fuser unit 5 of the disclosure is described with reference to FIG. 7. In the second illustrative embodiment, the same members as the first illustrative embodiment are denoted with the same reference numerals and the descriptions thereof are omitted.

In the fuser unit 5 of the first illustrative embodiment, the urging member 31 is arranged at the substantial center in the front-rear direction so that the lower-end portion thereof is contacted to the holding portion 56 of the covering part 51 of the stay cover 29 and the upper-end portion thereof is contacted to the inner circumferential surface of the inner surface guide 62 of the belt guide 30.

In contrast, according to the fuser unit 5 of the second illustrative embodiment of the disclosure, two urging members 31 are provided for one belt guide 30, and are respectively arranged between the rear lower-end portion of the inner surface guide 62 and the upper-end portion of the first rubbing part 52 and between the front lower-end portion of the inner surface guide 62 and the upper-end portion of the second rubbing part 53. In other words, the two urging members 31 are respectively arranged at downstream and upstream sides of the endless belt 21 with respect to the circulating direction thereof.

According to the fuser unit 5 of the second illustrative embodiment, it is possible to apply the tension to the endless belt 21 in a balanced manner by using the two urging members 31.

What is claimed is:

1. A fuser unit comprising:

an endless belt, which has an end portion having an end surface in a first direction and an inner circumferential surface;

a nip member, which is elongated in the first direction and is arranged inside the endless belt;

a roller, the roller and the nip member being configured to pinch the endless belt therebetween to form a nip portion where a sheet is to be conveyed in a conveyance direction;

a metal stay configured to support the nip member;

a belt guide includes:

a restraining part, which is arranged to be in contact with the end surface of the endless belt and configured to restrain the endless belt from moving in the first direction;

an inner surface guide, which extends from the restraining part into an inside of the endless belt and guides the inner circumferential surface of the endless belt, the inner surface guide having a contact surface, which is arranged to be in contact with the inner circumferential surface of the endless belt, and an opposite surface opposite to the contact surface;

a first guide protrusion protruding from the opposite surface of the inner surface guide toward the metal stay; and a second guide protrusion protruding from the opposite surface of the inner surface guide toward the metal stay, the second guide protrusion being disposed at an upstream side relative to the first guide protrusion and spaced apart from the first guide protrusion;

a frame covering the metal stay and having a groove where the first guide protrusion and the second guide protrusion are inserted; and a coil spring, which is configured to urge the belt guide in an urging direction so that the inner surface guide is urged toward the inner circumferential surface of the endless belt, wherein the coil spring is disposed between the first guide protrusion and the second guide protrusion and is disposed between the inner surface guide of the belt guide and the metal stay.

2. The fuser unit according to claim 1, wherein the first and second guide protrusions protrude in the first direction.

3. The fuser unit according to claim 1, wherein the coil spring is arranged between the frame and the inner surface guide.

4. The fuser unit according to claim 3, wherein the coil spring is arranged at a position corresponding to a substantial center of the inner surface guide, as seen from the first direction.

5. The fuser unit according to claim 3, wherein the coil spring includes:

a first spring; and a second spring, which is disposed at an upstream side in the conveyance direction, with respect to the first guide protrusion, and which is spaced apart from the first spring.

6. The fuser unit according to claim 1, further comprising:

a halogen heater configured to heat the nip member.

7. The fuser unit according to claim 1, wherein the groove of the frame includes a first groove where the first guide protrusion is inserted and a second groove where the second guide protrusion is inserted.

8. A fuser unit comprising:

a nip member, which extends in a first direction;

an endless belt, which has an end portion having an end surface in a first direction and extends around the nip member, the endless belt having an inner circumferential surface;

a roller, wherein the roller and the nip member are configured to pinch the endless belt therebetween to form a nip portion in which a sheet is to be conveyed in a conveyance direction;

a belt guide including:

a restraining part having a restraining surface which is arranged to be in contact with the end surface of the endless belt to restrain the endless belt from moving in the first direction and opposite surface opposite to the restraining surface; and an inner surface guide, which extends from the restraining part into an inside of the endless belt and guides the inner circumferential surface of the endless belt, the inner surface guide having a guide surface, which is arranged to be in contact with the inner circumferential surface, and an opposite surface opposite to the guide surface;

a spring, which is arranged inside the endless belt and configured to press the opposite surface of the inner surface guide of the belt guide towards the inner circumferential surface of the endless belt; and a facing member facing the opposite surface of the restraining part and having a contact surface arranged to be in contact with the opposite surface of the restraining part.

9. The fuser unit according to claim 8, wherein the inner surface guide of the belt guide is arranged between the inner circumferential surface of the endless belt and the spring, and wherein the spring is configured to press the inner surface guide of the belt guide towards the inner circumferential surface of the endless belt.

10. The fuser unit according to claim 8, wherein the belt guide includes:

a first guide protrusion; and a second guide protrusion, which is spaced apart from the first guide protrusion, wherein the spring is arranged between the first guide protrusion and the second guide protrusion.

11. The fuser unit according to claim 8, wherein the spring is disposed at an upstream side in the conveyance direction, with respect to the nip portion.

12. The fuser unit according to claim 8, wherein the spring is disposed at a downstream side in the conveyance direction, with respect to the nip portion.

13. The fuser unit according to claim 8, wherein the opposite surface of the restraining part has a curved surface protruding toward the contact surface of the facing member, the curved surface being arranged to be in contact with the contact surface of the facing member.

14. The fuser unit according to claim 8, wherein the opposite surface of the restraining part has a protruding surface protruding toward the contact surface of the facing member, the protruding surface being arranged to be in contact with the contact surface of the facing member.

15. A fuser unit comprising:

a nip member, which extends in a first direction;

an endless belt, which has an end portion having an end surface in the first direction and extends around the nip member;

a roller, wherein the roller and the nip member are configured to pinch the endless belt therebetween to form a nip portion, wherein a sheet is to be conveyed in a conveyance direction;

a belt guide including:

a restraining part, which is arranged to be in contact with the end surface of the endless belt to restrain the endless belt from moving in the first direction; and an inner surface guide, which is fixed on the restraining part, extends into an inside of the endless belt and guides an inner circumferential surface of the endless belt;

a first spring, which is arranged inside the endless belt and is configured to press the belt guide towards the inner circumferential surface of the endless belt; and a second spring, which is arranged inside the endless belt and configured to press the belt guide towards the inner circumferential surface of the endless belt, the second spring being disposed at an upstream side relative to the first spring in the conveyance direction and being spaced apart from the first spring.

16. The fuser unit according to claim 15, wherein the inner surface guide is integrally formed with the restraining part.

* * * * *